US010473356B2

(12) United States Patent
Kato et al.

(10) Patent No.: US 10,473,356 B2
(45) Date of Patent: Nov. 12, 2019

(54) INDOOR UNIT FOR AIR CONDITIONER

(71) Applicant: Hitachi-Johnson Controls Air Conditioning, Inc., Tokyo (JP)

(72) Inventors: Fumihiro Kato, Tokyo (JP); Naoki Muramatsu, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 15/741,806

(22) PCT Filed: Jul. 8, 2015

(86) PCT No.: PCT/JP2015/069688
§ 371 (c)(1),
(2) Date: Jan. 4, 2018

(87) PCT Pub. No.: WO2017/006467
PCT Pub. Date: Jan. 12, 2017

(65) Prior Publication Data

US 2018/0202684 A1 Jul. 19, 2018

(51) Int. Cl.
*F24F 13/08* (2006.01)
*F24F 1/0047* (2019.01)
(Continued)

(52) U.S. Cl.
CPC ..... *F24F 13/08* (2013.01); *F24F 1/0007* (2013.01); *F24F 1/0022* (2013.01);
(Continued)

(58) Field of Classification Search
CPC ..... F24F 13/08; F24F 2001/0037; F24F 1/00; F24F 13/32; F24F 1/0059; F24F 1/0022
See application file for complete search history.

(56) References Cited

U.S. PATENT DOCUMENTS

2010/0050678 A1* 3/2010 Ikeda ..... F04D 17/06 62/291
2010/0192611 A1* 8/2010 Yamaguchi ..... F24F 1/0014 62/291
(Continued)

FOREIGN PATENT DOCUMENTS

CN 204141823 U 2/2015
EP 0 926 452 A1 6/1999
(Continued)

OTHER PUBLICATIONS

Japanese Office Action received in corresponding Japanese Application No. 2017-527042 dated Sep. 11, 2018.
(Continued)

*Primary Examiner* — Ana M Vazquez
(74) *Attorney, Agent, or Firm* — Mattingly & Malur, PC

(57) ABSTRACT

An indoor unit of an air conditioner includes a guide member provided below an air discharge port of a blower fan and upstream of the heat exchanger. The guide member has a guide portion disposed to face an end surface upstream of the heat exchanger, and the guide portion is a plate body whose cross-section has a linear shape parallel to the end surface when cut along a plane including a rotation axis of the blower fan. Thus, provided is the indoor unit of the air conditioner capable of more uniformly guiding air from the blower fan in a height direction of the heat exchanger by the compact and inexpensive guide member.

6 Claims, 4 Drawing Sheets

(51) Int. Cl.

| | |
|---|---|
| ***F24F 1/0022*** | (2019.01) |
| ***F24F 1/0059*** | (2019.01) |
| ***F24F 13/02*** | (2006.01) |
| ***F24F 1/0007*** | (2019.01) |

(52) U.S. Cl.
CPC ..... *F24F 1/0047* (2019.02); *F24F 1/0059* (2013.01); *F24F 13/02* (2013.01)

(56) References Cited

U.S. PATENT DOCUMENTS

| | | | | |
|---|---|---|---|---|
| 2012/0308370 | A1* | 12/2012 | Nagae | F04D 29/162 415/203 |
| 2014/0231051 | A1 | 8/2014 | Cho et al. | |
| 2016/0054010 | A1* | 2/2016 | Suhara | F24F 1/0007 62/426 |

FOREIGN PATENT DOCUMENTS

| | | | | |
|---|---|---|---|---|
| JP | 7-137533 | A | 5/1995 | |
| JP | 2002-147781 | A | 5/2002 | |
| JP | 2003-083599 | A | 3/2003 | |
| JP | 2004-156885 | A | 6/2004 | |
| JP | 2007-239236 | A | 9/2007 | |
| JP | 2011-163740 | A | 8/2011 | |
| WO | WO-2014178176 | A1 * | 11/2014 | F24F 1/0007 |

OTHER PUBLICATIONS

International Search Report of PCT/JP2015/069688 dated Oct. 13, 2015.

Extended European Search Report received in corresponding European Application No. 15897729.8 dated Jan. 25, 2019.

* cited by examiner

INDOOR UNIT FOR AIR CONDITIONER

TECHNICAL FIELD

The present invention relates to an indoor unit of an air conditioner, and especially to an indoor unit for a ceiling-embedded type air conditioner.

BACKGROUND ART

As the indoor unit of the air conditioner, there is an indoor unit which is embedded in a ceiling (ceiling-embedded type). The indoor unit of the ceiling-embedded type air conditioner sucks indoor air by rotating a centrifugal fan, cools the sucked air by a heat exchanger during cooling, and blows out the air from an outlet thereof to cool a room.

Although the centrifugal fan discharges the air toward the heat exchanger, since height of a discharge port of the centrifugal fan is about half height of the heat exchanger, the air does not uniformly hit an entire region in a height direction of the heat exchanger. As a result, since heat transfer performance of the heat exchanger is degraded, cooling capacity is reduced. On the other hand, an increase of a volume of the air to compensate for the reduction in the cooling capacity leads to an increase in noise and an increase in fan power.

In contrast, there has been proposed an indoor unit including a flow path expansion member which gently spreads a flow of the air blown out from the fan toward the heat exchanger (see Patent Document 1).

CITATION LIST

Patent Literature

Patent Document 1: Japanese Patent Application Publication No. 2004-156885

SUMMARY OF INVENTION

Technical Problem

In the indoor unit described in Patent Document 1, it is intended that the air sent from the fan flows adhering to the flow path expansion member which gently expands (see paragraph 0017 of Patent Document 1). However, since the air from the fan is directly sent out toward the heat exchanger, there is a possibility that the air discharged particularly from a lower portion of the discharge port of the fan does not flow along the flow path expansion member. In that case, less air flows into a lower portion of the heat exchanger. In addition, since the flow path expansion member described in Patent Document 1 has a large-sized and complicated shape, a mounting space is also necessary, which leads to an increase in cost.

The present invention has been made in view of the above circumstances, and an object of the present invention is to provide an indoor unit of an air conditioner capable of more uniformly guiding air from a blower fan in a height direction of a heat exchanger by a compact and inexpensive member.

Solution to Problem

In order to solve the above problem, an indoor unit of an air conditioner according to the present invention includes a fan motor provided in a housing, a blower fan rotated by the fan motor, a heat exchanger enclosing a discharge direction of air from the blower fan, and a guide member provided below an air discharge port of the blower fan and upstream of the heat exchanger, wherein the guide member has a guide portion disposed to face an end surface upstream of the heat exchanger, and the guide portion has a linear cross-sectional shape parallel to the end surface when cut along a plane including a rotation axis of the blower fan.

Advantageous Effects of Invention

According to the present invention, it is possible to provide an indoor unit of an air conditioner capable of more uniformly guiding air from a blower fan in a height direction of a heat exchanger by a compact and inexpensive member.

DESCRIPTION OF EMBODIMENTS

Figure 1:
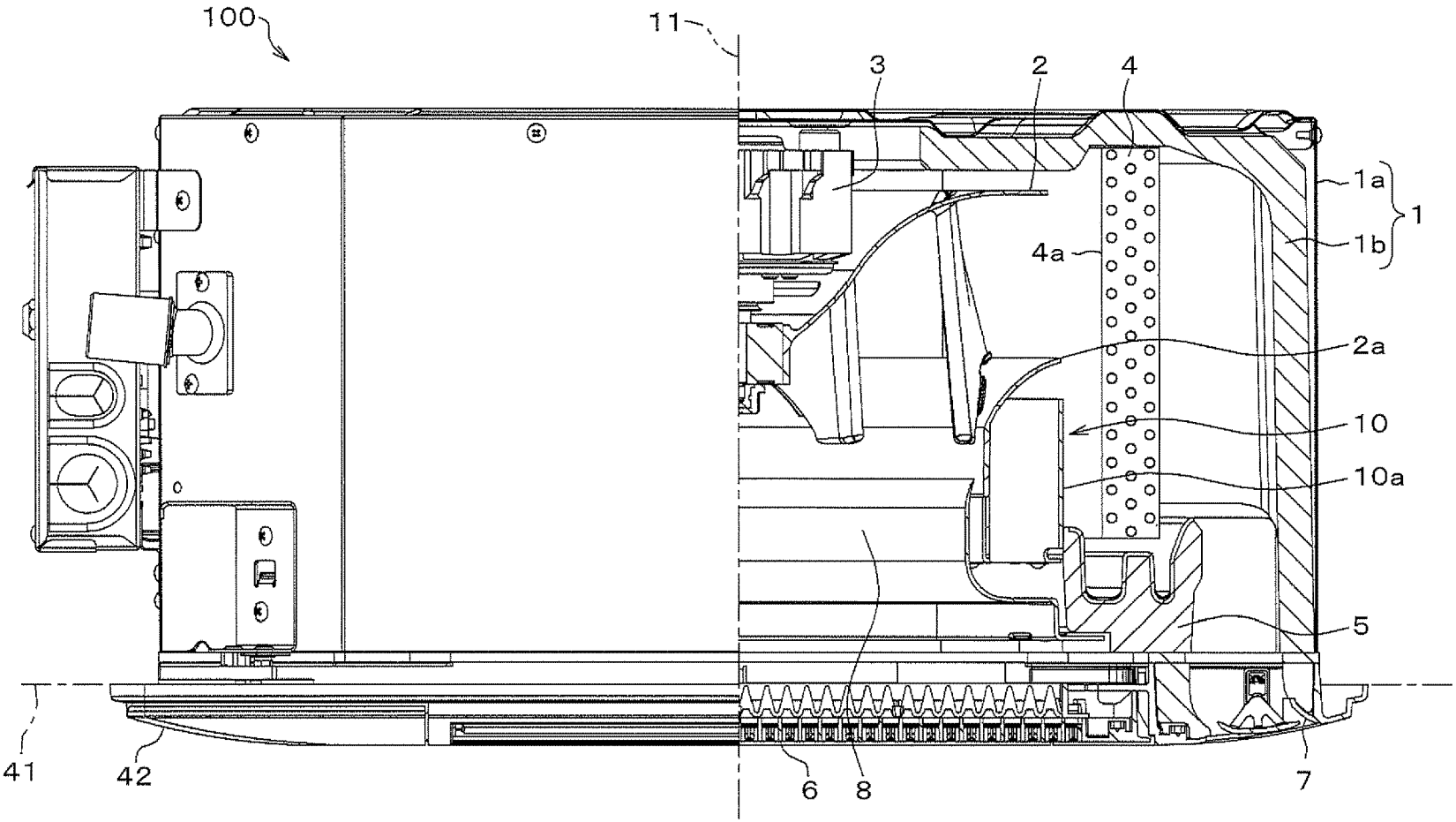
FIG. 1 is a half cross-sectional view of an indoor unit of an air conditioner according to an embodiment of the present invention.

An embodiment of the present invention will be described in detail with reference to the drawings. Note that the same members are denoted by the same reference numerals in the following drawings.

Figure 2:
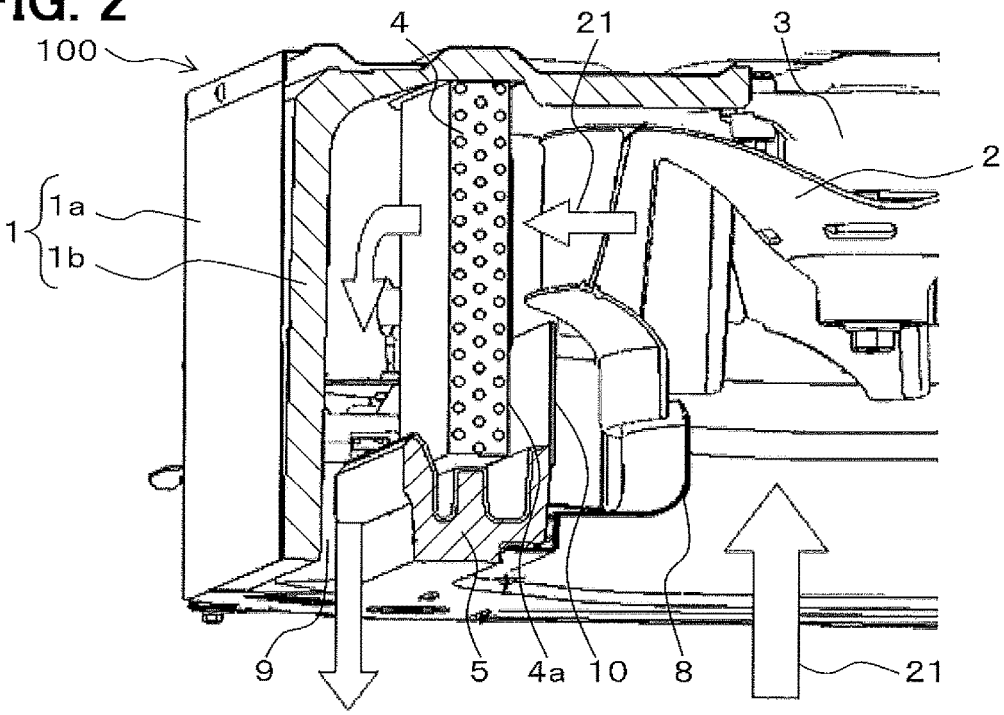
FIG. 2 is a cross-sectional perspective view for explaining a flow of air in the indoor unit shown in FIG. 1.

FIG. 1 is a half cross-sectional view of an indoor unit 100 (hereinafter also simply referred to as an "indoor unit") of an air conditioner according to an embodiment of the present invention. FIG. 2 is a cross-sectional perspective view for explaining a flow of air in the indoor unit 100 shown in FIG. 1. FIG. 2 shows a state in which a decorative panel 42 (see FIG. 1) is removed.

As shown in FIG. 1, the indoor unit 100 according to the present embodiment is an (ceiling-embedded type) indoor unit of a type embedded in a ceiling 41. In the air conditioner according to the present embodiment, the indoor unit 100 and an outdoor unit (not shown) are connected by a refrigerant pipe (not shown) to constitute a refrigeration cycle and perform air conditioning.

The indoor unit 100 has a main body case 1 and the decorative panel 42. A lower surface of the decorative panel 42 faces inside a room, and the main body case 1 is embedded inside the ceiling 41. The decorative panel 42 is mounted below the main body case 1 so as to be substantially flush with a surface of the ceiling 41. The main body case 1 is installed and fixed on a ceiling back (above the surface of the ceiling 41) by using a hanger bracket and a hanger bolt (not shown). The decorative panel 42 is fixed to the main body case 1 using screw members (not shown) or the like.

Figure 4:
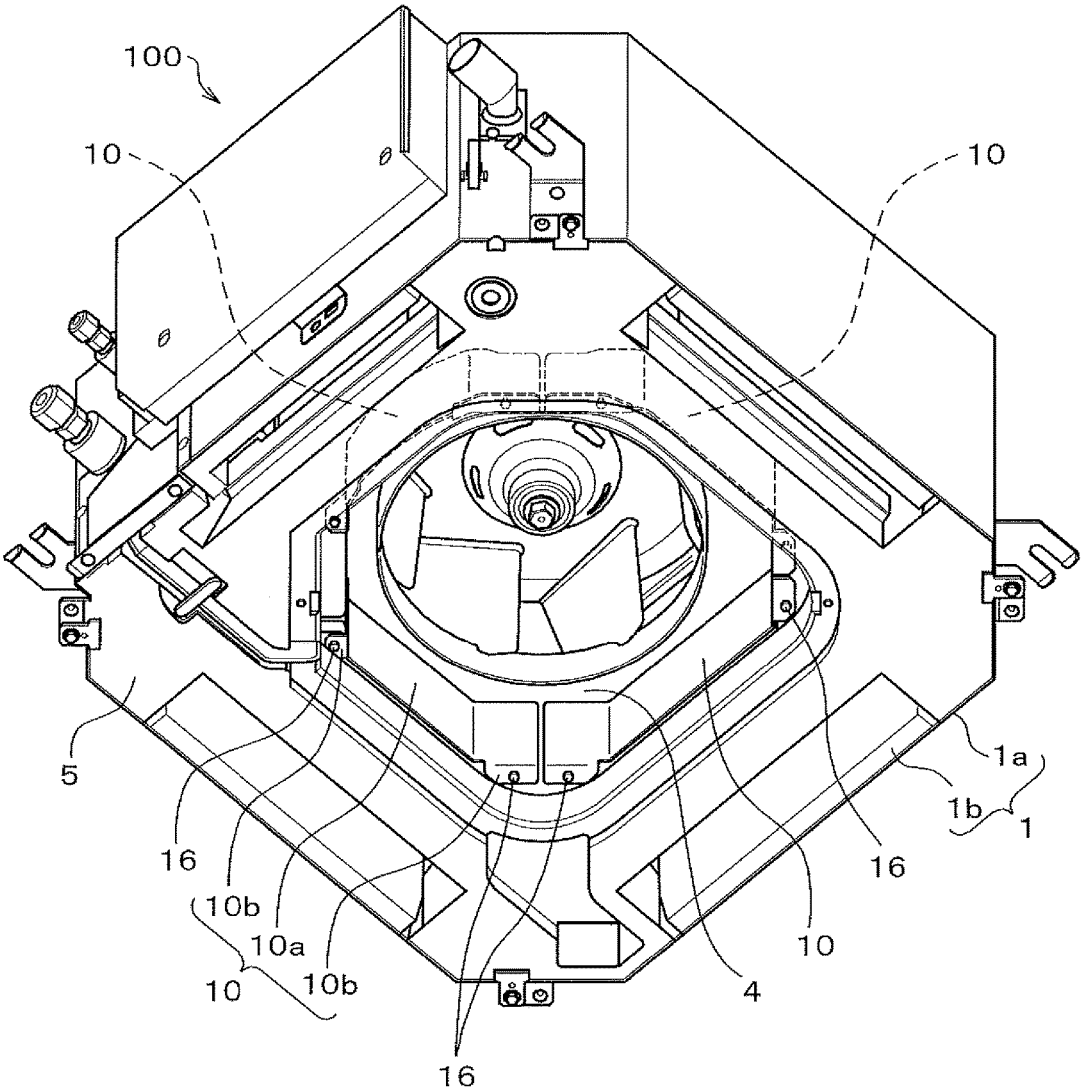
FIG. 4 is a perspective view of the indoor unit viewed from below for explaining the mounting structure of the guide member.

The main body case 1 includes a housing 1*a* and a heat insulating material 1*b*. The housing 1*a* has a rectangular shape in plan view, and is formed in a bottomed box shape having a downward opening using a metal plate. Here, the "rectangular shape" is a concept including not only "strict rectangular shape" but also "substantially rectangular shape" having corners, for example, chamfered or rounded. Note that FIG. 4 shows the rectangular shape having corners chamfered by short straight lines, and it can also be expressed as a polygonal shape including the corners. The housing 1*a* is formed such that two or more sheet metals are formed into a predetermined shape by pressing to be joined with screws, rivets or the like. In the main body case 1, the heat insulating material 1*b* for heat insulation, dew condensation prevention, sound insulation and the like is disposed with its opening facing downward inside the housing 1*a*.

The indoor unit 100 includes a blower fan 2 provided in the housing 1*a*, a heat exchanger 4 surrounding a discharge direction of air from the blower fan 2, a guide member 10 provided below an air discharge port 2*a* of the blower fan 2 and upstream of the heat exchanger 4. The blowing fan 2 is, for example, a centrifugal fan, and changes the direction of flow of the air by about 90 degrees to send the air to the heat exchanger 4. The blower fan 2 is rotated by a fan motor 3 provided in the housing 1*a*. The fan motor 3 is fixed to a top plate of the housing 1*a*. The blower fan 2 and the fan motor 3 constitute a blower.

A drain pan 5 is disposed below the heat exchanger 4. The drain pan 5 receives and collects drain water which is condensed on a surface of the heat exchanger 4 and drops. The drain pan 5 is, for example, a foamed polystyrene molded product, and a resin layer made of resin such as ABS resin is formed on an inner surface side thereof, which the drain water contacts.

An air inlet 6 is provided at a center of a lower surface of the indoor unit 100. Air outlets 7 (four places in this case) are provided on a lower surface peripheral edge of the indoor unit 100. The blower fan 2 is provided in an air passage connecting the air inlet 6 and the outlets 7 in the housing 1*a*. The heat exchanger 4 is disposed between the blower fan 2 and the outlets 7. A bell mouth 8 is provided between the blower fan 2 and the air inlet 6.

As shown in FIG. 2, indoor air 21 is sucked from the air inlet 6 (see FIG. 1) by rotational operation of the blower fan 2 and is blown out toward the heat exchanger 4 through the blower fan 2. In case of cooling operation, the air 21 is cooled by passing through the heat exchanger 4. The air 21 cooled through the heat exchanger 4 passes through a blowout air duct 9 formed between the drain pan 5 and the heat insulating material 1*b* of the main body case 1, passes through the outlets 7 (see FIG. 1), and is blown out from the indoor unit 100 into the room.

Figure 3:
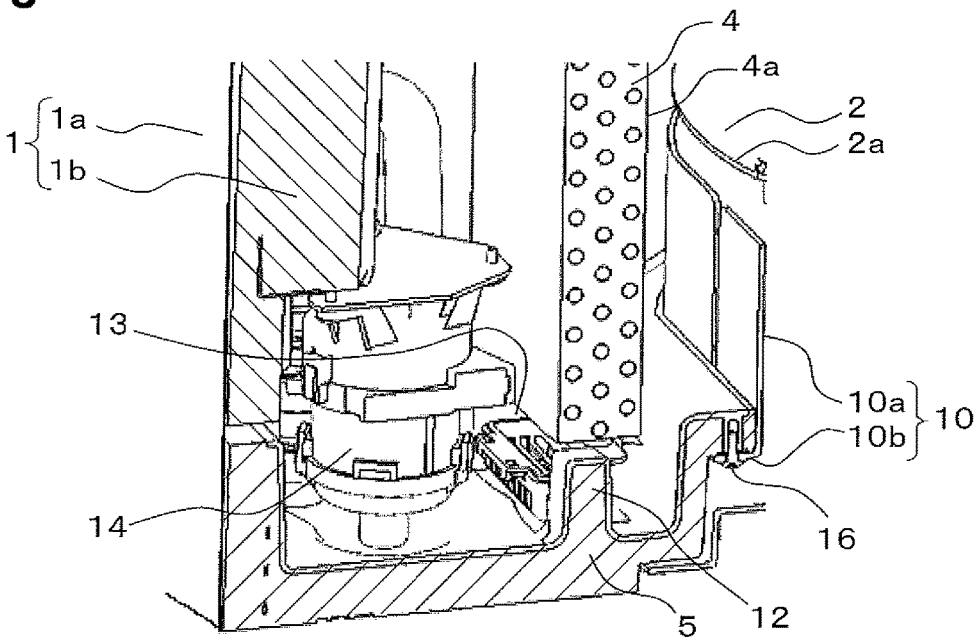
FIG. 3 is a cross-sectional perspective view for explaining a mounting structure of a guide member.

FIG. 3 is a cross-sectional perspective view for explaining a mounting structure of the guide member 10. FIG. 4 is a perspective view of the indoor unit 100 viewed from below for explaining the mounting structure of the guide member 10. FIG. 3 shows a state in which the decorative panel 42 (see FIG. 1) is removed. Further, FIG. 4 shows a state in which the decorative panel 42 and the bell mouth 8 (see FIG. 1) are removed.

As shown in FIG. 3, the indoor unit 100 (see FIG. 1) includes a drain pump 14 for discharging the drain water accumulated in the drain pan 5. The drain pan 5 has a partition wall 12 partitioning a primary space located on an upstream side (primary side) of the flow of the air 21 (see FIG. 2) of the heat exchanger 4 on the drain pan 5 and a secondary space located on a downstream side (secondary side) thereof. The partition wall 12 is formed with an opening groove 13 partially cut out to communicate the primary space and the secondary space. The drain water flowing down onto the drain pan 5 is guided toward the drain pump 14 and is drawn up by the drain pump 14 to be discharged outside the unit.

As shown in FIGS. 3 to 4, the guide member 10 has a guide portion 10*a* disposed to face an end surface 4*a* upstream of the heat exchanger 4, and a fixed portion 10*b* fixed to the drain pan 5 by screwing from below with a screw member 16. The guide portion 10*a* of the guide member 10 is brought into contact with an end surface on an inner side (on the blower fan 2 side) of the drain pan 5.

The guide portion 10*a* is a plate body whose cross-section has a linear shape parallel to the end surface 4*a* upstream of the heat exchanger 4 when cut along a plane including a rotation axis 11 (see FIG. 1) of the blower fan 2. Here, "parallel" is a concept including not only "strict parallel" but also "substantially parallel" recognized as "parallel" in view of technical common sense. Further, the "linear shape" is a concept including not only a "strict linear shape" but also a "substantially linear shape" recognized as a "linear shape" in view of technical common sense.

The fixed portion 10*b* extends horizontally outward from a lower end of the guide portion 10*a*. The guide member 10 is formed by integrally molding the guide portion 10*a* and the fixed portion 10*b*. The guide member 10 is formed of a resin material in this case.

As shown in FIG. 4, the fixed portions 10*b* of the guide member 10 are respectively arranged at positions corresponding to four corners in the housing 1*a* having a rectangular shape in plan view.

The guide member 10 is disposed over an entire circumference in a radially inner direction around the rotation axis 11 (see FIG. 1) in the heat exchanger 4. Here, the "entire circumference" is a concept including not only "strict entire circumference" but also "substantially entire circumference" recognized as an "entire circumference" in view of technical common sense.

Further, the guide member 10 is divided into a plurality of portions in a circumferential direction around the rotation axis 11. That is, a plurality of (four in this case) guide members 10 are arranged adjacent to each other in the circumferential direction around the rotation axis 11. The guide members 10 respectively include the fixed portions 10*b* at both ends thereof and the both ends are arranged at positions corresponding to the corners in the housing 1*a*.

Next, operation of the guide member 10 in the indoor unit 100 configured as described above will be described.

Figure 5:
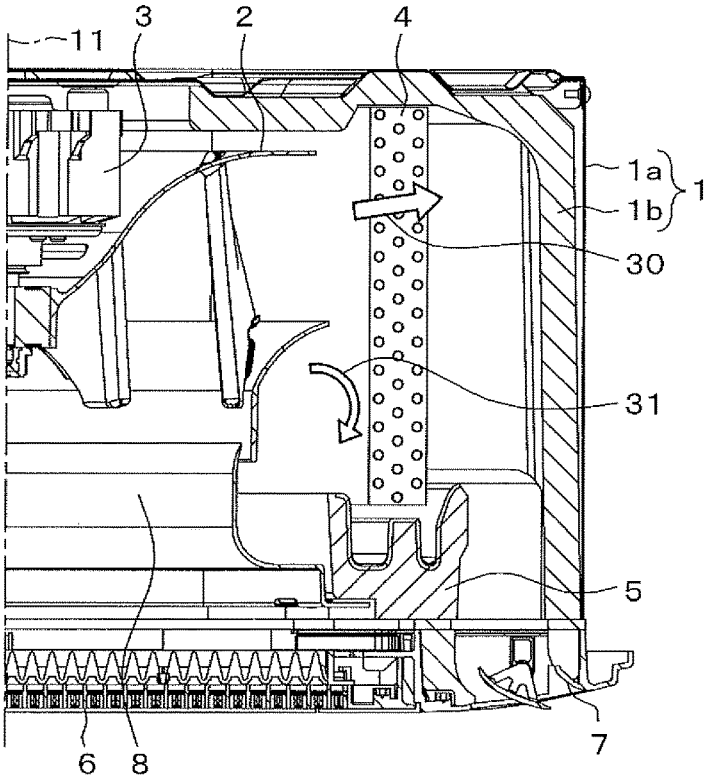
FIG. 5 is a view for explaining a flow of air inside the indoor unit having no guide member as a comparative example.

First, a flow of air inside the indoor unit not having the guide member 10 will be described as a comparative example with reference to FIG. 5. As shown in FIG. 5, the flow of the air indicated by an arrow 30 sent from the blower fan 2 causes a swirling flow indicated by an arrow 31 on a front side of a lower portion of the heat exchanger 4. Therefore, an amount of air passing through the lower portion of the heat exchanger 4 decreases, resulting in uneven wind speed distribution with respect to a height direction of the heat exchanger. Here, "height" is a dimension in a direction parallel to the rotation axis 11 of the blower fan 2. On the other hand, when the amount of air is increased by increasing a rotational speed of the blower fan 2 in order to compensate for decrease in the amount of air passing through the lower portion of the heat exchanger 4, adverse effects such as an increase in noise and an increase in fan power occur.

Figure 6:
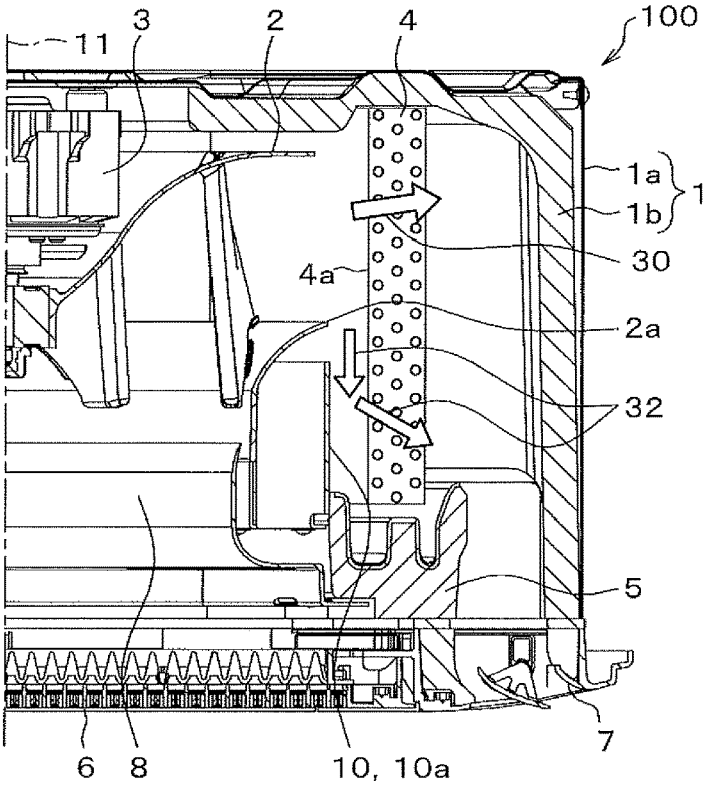
FIG. 6 is a view for explaining a flow of air inside the indoor unit having the guide member according to the present embodiment.

FIG. 6 is a view for explaining a flow of air inside the indoor unit 100 having the guide member 10 according to the present embodiment.

As described above, the indoor unit 100 of the air conditioner according to the present embodiment includes the guide member 10 provided below the air discharge port 2*a* of the blower fan 2 and upstream of the heat exchanger 4. The guide member 10 has a guide portion 10*a* disposed to face the end surface 4*a* upstream of the heat exchanger 4, and the guide portion 10*a* is a plate body whose cross-section has a linear shape parallel to the end surface 4*a* when cut along the plane including the rotation axis 11 of the blower fan 2.

In the present embodiment as described above, occurrence of the swirling flow indicated by the arrow 31 in FIG. 5 is prevented by the guide member 10 as shown in FIG. 6. The flow of the air indicated by the arrow 30 sent from the blower fan 2 causes a flow indicated by an arrow 32 passing between the guide member 10 and the heat exchanger 4, and passing through the lower portion of the heat exchanger 4. Thus, the wind speed distribution more uniformly spreads in the height direction of the heat exchanger 4, and it is possible to effectively utilize an entire heat exchanger 4. Therefore, heat transfer performance of the heat exchanger 4 is improved, and for example, cooling capacity is improved during cooling operation. In addition, since the guide member 10 does not need to have a complicated structure difficult to manufacture, space saving and cost saving can be achieved.

That is, according to the present embodiment, it is possible to provide the indoor unit 100 of the air conditioner capable of more uniformly guiding the air from the blower fan 2 in the height direction of the heat exchanger 4 by the compact and inexpensive guide member 10.

In order to more effectively prevent occurrence of the swirling flow as indicated by the arrow 31 in FIG. 5, it is desirable that a distance in the height direction between a lower end of the discharge port 2*a* of the blower fan 2 and an upper end of the guide member 10 is as small as possible within a range in which the blower fan 2 and the guide member 10 do not contact each other.

Further, in the present embodiment, as shown in FIGS. 3 to 4, the fixed portion 10*b* of the guide member 10 is fixed to the drain pan 5 by screwing from below with the screw member 16. Therefore, even when it is necessary to remove the blower fan 2 or the fan motor 3 for maintenance purposes after installation of the indoor unit 100, it is not necessary to remove the drain pan 5, which is difficult to handle because the drain water is accumulated therein, from the main body case 1. That is, by removing the screw members 16 for fixing the guide member 10 and removing the guide member 10 from the drain pan 5, it is possible to easily perform maintenance of the blower fan 2 and the fan motor 3.

Further, in the present embodiment, the fixed portion 10*b* of the guide member 10 is disposed at a position corresponding to a corner in the housing 1*a* having a rectangular shape in plan view. With such a configuration, it is possible to easily lay out a female screw portion for screwing the screw member 16 for fixing the guide member 10 from below to the drain pan 5 by using a space existing at the corner in the housing 1*a*.

The guide member 10 is provided on the side of the air inlet 6 but is provided to face the heat exchanger 4, and thus it is in a position more susceptible to radiant heat from the heat exchanger 4 during the cooling operation of the air conditioner. Therefore, when surface temperature of the guide member 10 is lowered to a dew point or below, dew condensation occurs from the sucked air 21 (see FIG. 2) on the surface of the guide member 10. When dew condensation occurs and grows, there is a possibility that dew condensation water falls from the air inlet 6, leading to a problem of water dripping. Therefore, in the present embodiment, the guide member 10 is formed of a resin material having a thermal conductivity lower than that of metal. Thus, since the guide member 10 is less susceptible to the radiant heat, there is an advantage that the surface temperature hardly decreases, and dew condensation water is unlikely generated on the surface of the guide member 10.

Further, in the present embodiment, the guide member 10 is disposed over the entire circumference in the radially inner direction around the rotation axis 11 in the heat exchanger 4. With this configuration, the guide member 10 can have a sufficient effect at any position in the circumferential direction around the rotation axis 11. Therefore, the heat transfer performance of the heat exchanger 4 is further improved.

Further, in the present embodiment, the guide member 10 is divided into the plurality of portions in the circumferential direction around the rotation axis 11. With such a configuration, it is easy to manufacture and store the guide member 10 and burden of mounting work of the guide member 10 is reduced.

Although the present invention has been described based on the embodiments, the present invention is not limited to the embodiments described above, but includes various modifications. For example, the above-described embodiments have been described in detail in order to clarify the present invention, and are not necessarily limited to those having all the components described above. Further, it is possible to add, delete, or replace other components with respect to a part of the components of the embodiment.

For example, in the embodiment described above, the guide member 10 is divided into four portions in an example of FIG. 4, but the present invention is not limited thereto. The guide member 10 may be divided into, for example, two portions, or may be an integrally molded product not divided.

REFERENCE SIGNS LIST

1: main body case
1*a*: housing
2: blower fan
2*a*: discharge port
3: fan motor
4: heat exchanger
4*a*: end surface
5: drain pan
6: air inlet
7: air outlet
8: bell mouth
9: blowout air duct
10: guide member
10*a*: guide portion
10*b*: fixed portion
11: rotation axis
14: drain pump
16: screw member
21: air
41: ceiling
100: indoor unit of air conditioner

The invention claimed is:

1. An indoor unit of an air conditioner comprising:
a fan motor provided in a housing;
a blower fan rotated by the fan motor;
a heat exchanger enclosing a discharge direction of air from the blower fan;

a drain pan disposed below the heat exchanger and receiving drain water; and a guide member provided below an air discharge port of the blower fan and upstream of the heat exchanger with respect to the discharge direction of air, wherein the guide member has a guide portion disposed to face an end surface of the heat exchanger that is on an upstream side of the heat exchanger, and wherein the guide portion of the guide member is an entirety of the guide member that is disposed above a highest top surface of the drain pan that is between the guide portion and the heat exchanger and the entirety of the guide portion has a linear cross-sectional shape parallel to the end surface when cut along a plane including a rotation axis of the blower fan.

2. The indoor unit of the air conditioner according to claim 1, further comprising wherein the guide member has a fixed portion extending perpendicularly to the guide portion that is fixed to the drain pan with a screw through the fixed portion and an underside of the drain pan that is parallel to the highest top surface of the drain pan.

3. The indoor unit of the air conditioner according to claim 2, wherein the fixed portion is disposed at a position corresponding to a corner in the housing having a rectangular shape in plan view.

4. The indoor unit of the air conditioner according to claim 1, wherein the guide member is formed of a resin material.

5. The indoor unit of the air conditioner according to claim 1, wherein the guide member is disposed over an entire circumference in a radially inner direction around the rotation axis in the heat exchanger.

6. The indoor unit of the air conditioner according to claim 5, wherein the guide member is divided into a plurality of portions in a circumferential direction around the rotation axis.

* * * * *